United States Patent [19]

Lindblad

[11] Patent Number: 4,763,168

[45] Date of Patent: Aug. 9, 1988

[54] REPRODUCING APPARATUS INCLUDING TONER REMOVAL APPARATUS UTILIZING ELECTROSTATIC ATTRACTION

[75] Inventor: Nero R. Lindblad, Palmyra, N.Y.

[73] Assignee: Xerox Corporation, Stamford, Conn.

[21] Appl. No.: 471,412

[22] Filed: Mar. 2, 1983

[51] Int. Cl.[4] ..... G03G 21/00

[52] U.S. Cl. ..... 355/15; 15/256.52

[58] Field of Search ..... 355/3 R, 15; 15/256.51, 15/256.52

[56] References Cited

U.S. PATENT DOCUMENTS

| | | | |
|---|---|---|---|
| 3,617,123 | 11/1971 | Emerson | 355/15 |
| 3,649,263 | 3/1972 | Cade et al. | 96/1.4 |
| 3,728,016 | 4/1973 | Harbour et al. | 355/15 |
| 3,780,391 | 12/1973 | Leenhouts | 355/15 X |
| 4,265,990 | 5/1981 | Stolka et al. | 430/59 |
| 4,361,922 | 12/1982 | Karal | 355/15 X |

OTHER PUBLICATIONS

Xerox copending U.S. application Ser. No. 438,227 filed Nov. 1, 1982 entitled "Cleaning Method & Apparatus for a Xerographic Reproducing Apparatus"; Bean et al.

*Primary Examiner*—Fred L. Braun

[57] ABSTRACT

Apparatus for cleaning residual toner from a photoconductive surface. Toner is temporarily removed from the surface by a conductive fiber brush wherein it is stored for a period of time dependent on the image area coverage and the transfer efficiency of the transfer device used. When the brush reaches its toner holding capacity, the toner is deposited back onto the surface and it is transported to the development system where it is recycled back into the developer housing for reuse. In one embodiment, the brush initially has a d.c. voltage applied to it of a polarity so as to attract toner to the brush after which a d.c. voltage of the opposite polarity is applied to the brush in order to detone the brush and thereby deposite it on the photoconductive surface. A charging device of the printing apparatus has a switch for temporarily inactivating the charging device to allow repelled toner to pass thereby unaltered.

1 Claim, 2 Drawing Sheets

Figure 1:
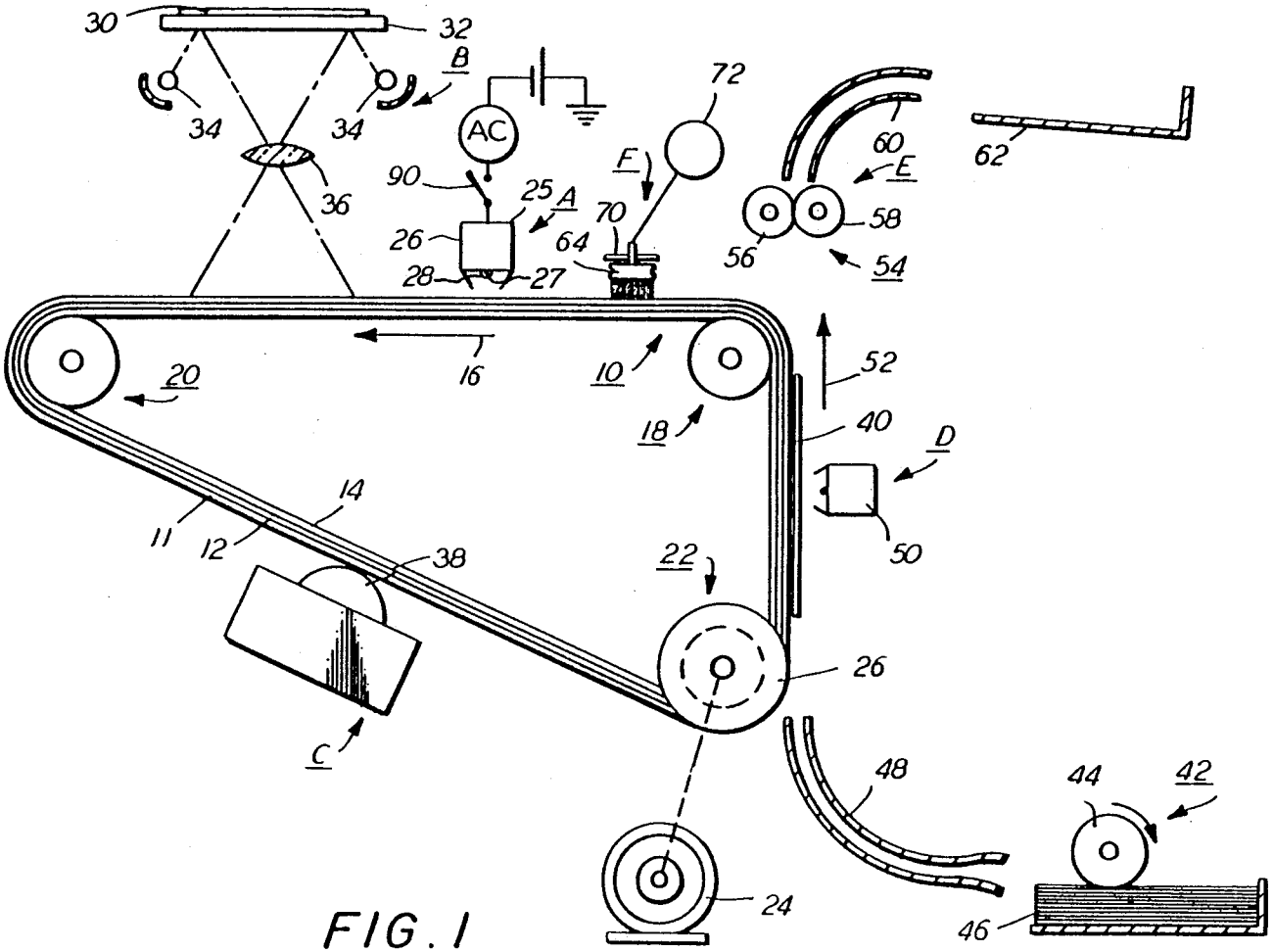

REPRODUCING APPARATUS INCLUDING TONER REMOVAL APPARATUS UTILIZING ELECTROSTATIC ATTRACTION

This invention relates to the art of xerography, in particular, to a method and apparatus for removing residual toner material from a photoconductor (P/R) surface of an automatic zerographic reproducing apparatus wherein development of the latent image and removal of residual toner are effected at a single station by the same structure.

In the art of xerography, a photoconductor generally comprising a photoconductive insulating material adhered to a conductive backing is charged uniformly. Then the P/R is exposed to a light image of an original document to be reproduced. The latent electrostatic images, thus formed, are rendered visible by applying any one of numerous pigmented resins specifically designed for this purpose. In the case of a reusable P/R, the pigmented resin, more commonly referred to as toner which forms the visible images is transferred to plain paper.

Although a preponderance of the toner forming the images is transferred to the paper during transfer, some toner remains on the P/R surface, it being held thereto by relatively high electrostatic and/or mechanical forces. It is essential for optimum operation that the toner remaining on the surface be cleaned thoroughly therefrom.

A commercially successful mode of cleaning employed in automatic xerography utilizes a brush with soft bristles which have suitable triboelectric characteristics. While the bristles are soft they are sufficiently firm to remove residual toner particles from the xerographic plate. In addition, webs or belts of soft fibrous or tacky materials and other cleaning systems are known. The foregoing types of cleaning devices require structure that is designed solely for the purpose of cleaning and require a certain amount of space contiguous the P/R.

In spite of the successes that have been achieved in removing residual toner from P/R surfaces there is still room for improvement. This is especially true in xerographic systems where the development and cleaning functions are effected at a single process station by the same structure. Such systems are commonly referred to as cleanerless systems because the conventional cleaning apparatus normally employed is not used. A cleanerless system is disclosed in U.S. Pat. No. 3,649,262 wherein apparatus is disclosed for removing residual toner images from a P/R surface simultaneously with the development of newly formed latent electrostatic images. In a cleanerless system such as disclosed in the foregoing patent, a separate cleaning structure is not utilized since the two component (i.e. carrier beads and toner) developer which is cascaded over the P/R surface during development is used for cleaning the residual toner therefrom. As stated in the patent, the residual images are removed by combinations of mechanical, triboelectric and electrostatic actions of the cascading developer.

Further efforts to improve upon the cleaning of the device disclosed in the U.S. Pat. No. 3,649,262 as illustrated in U.S. Pat. No. 3,617,123 utilized a vibrating brush as an adjunct to the cleaning effected by the developer system. There the vibrating brush is positioned upstream from the point where the P/R drum surface enters a combination development and cleaning station which is functionally similar to that disclosed in the U.S. Pat. No. 4,649,262. The brush is mounted longitudinally along the drum surface to be cleaned and is vibrated transversely across the drum surface. Thus, the brush serves to reposition the charged residual toner particles over the drum so that they can be more readily removed by the combination development and cleaning system. While the material from which the brush fibers are fabricated is not specified, it is clear from the patent disclosure that the material is electrically insulative otherwise it would act as a conductive path allowing at least some of the latent images on the drum to be dissipated. A brush of this type physically dislodges the built-up residual toner and tends to spread it over the imaging surface. However, after periods of extended use the toner becomes impregnated in the bristles of the brush resulting in the brush becoming ineffective for its intended purpose.

In accordance with features of the present invention, there is provided an improved apparatus for removing residual toner from a P/R surface simultaneously with the development of newly formed latent images. To this end, there is provided an electrically conductive brush which is electrically biased and cyclically moved transverse to the direction of movement of the P/R. The bristles forming the brush are constructed such that they can store a relatively large quantity of toner therein. In order for the brush to attract the toner from the P/R a d.c. voltage is applied to the conductive fibers thereby creating an electrostatic field the polarity of which is opposite to the charge on the toner. Once the brush becomes filled with toner, a d.c. voltage opposite to the polarity applied for attracting the toner is applied whereby the toner stored in the brush is deposited on the P/R for transporting to the developer station for removal. For optimum results the corona charging device is turned off until the P/R carries all of the deposited toner therepast.

The toner removal part of the cycle just described is commonly referred to as detoning of the P/R while the toner depositing part of the cycle is commonly known as toning of the P/R. The system is designed such that detoning takes place for a plurality of processing cycles (i.e. movement of a portion of the P/R past all the xerographic stations of the machine) before the toning or toner deposition action takes place. The number of cycles for which the brush is able to satisfactorily perform is a function of the area coverage and the efficiency with which the toner is transferred. Thus, if the transfer efficiency is low and the area coverage is high then the minimum number of copies can be made before the toner collected in the brush has to be depositied on the P/R for removal by the developer. Conversely, when the area coverage is low and the transfer is high the maximum number of copies can be made prior to the necessity of dumping the toner from the brush.

Other aspects of the present invention will become apparent as the following description proceeds with reference to the drawings.

FIG. 1 is a schematic elevational view depicting an electrophotographic printing machine incorporating the present invention.

Figure 2:
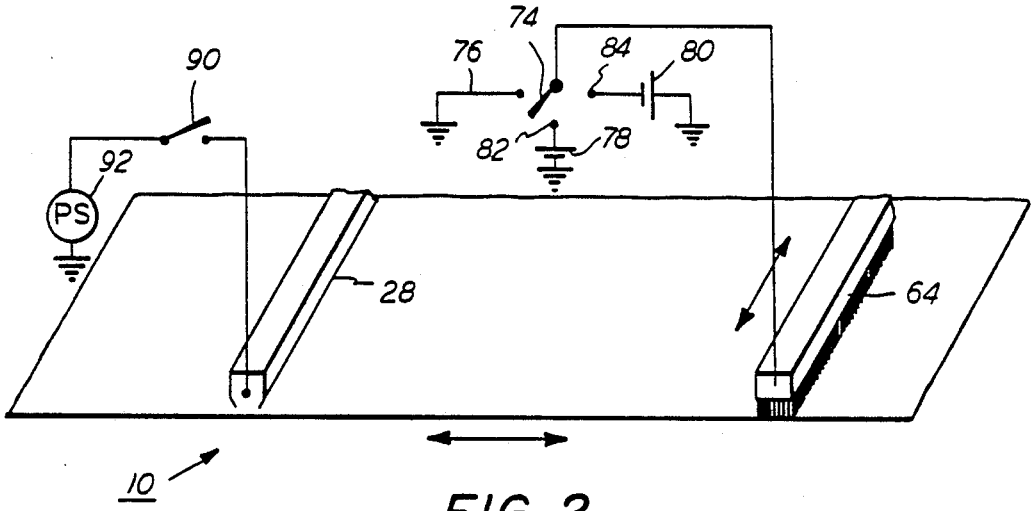
Figure 3:
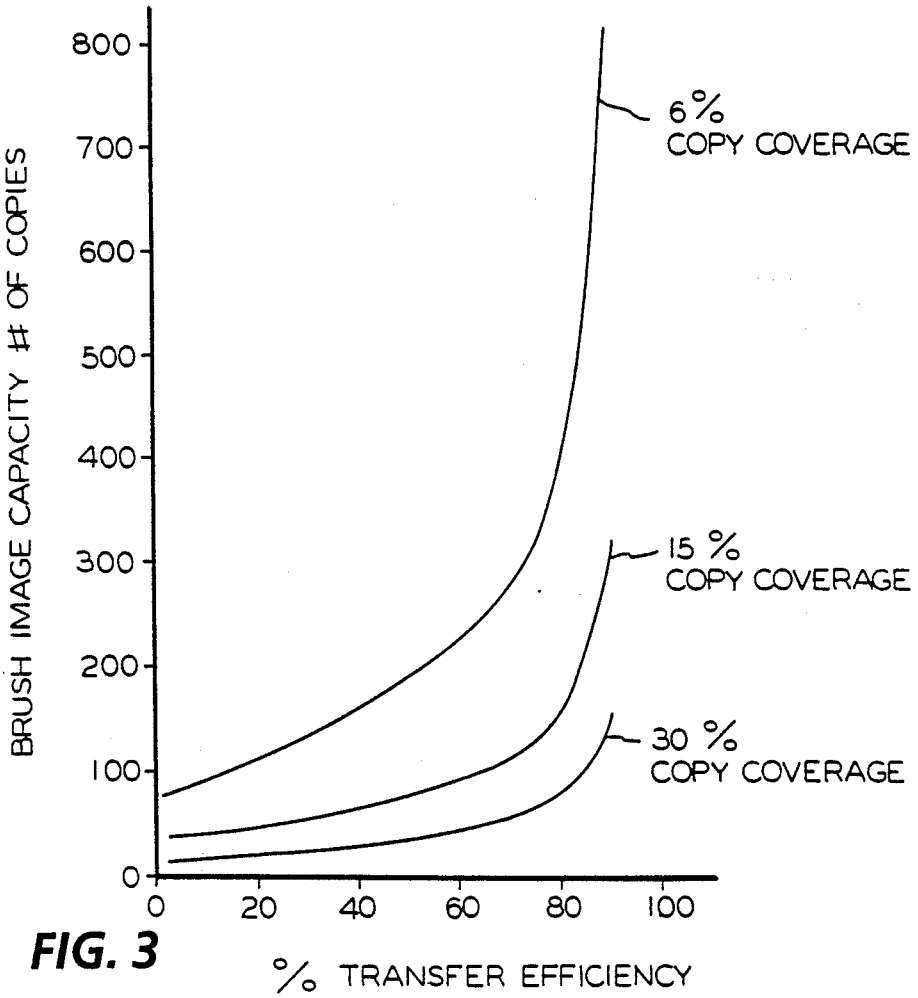

FIG. 2 is a fragmentary side elevational view of a conductive brush with voltage sources for accomplishing the desired operation of the detoning/toning of the P/R as well as toning/detoning of the conductive brush employed; and FIG. 3 is a plot of the number of copies that can be made before toner removal from the brush is required versus the toner transfer efficiency of the xerographic system in which the conductive brush of this invention is employed in addition to the percent area coverage of the images being processed.

For a general understanding of the features of the present invention, a description thereof will be made with reference to the drawings. In the drawings, like reference numerals have been used throughout to designate identical elements. FIG. 1 schematically depicts the various components of an illustrative electrophotographic printing machine incorporating the apparatus and method of the present invention therein.

Inasmuch as the art of electrophotographic printing is well known, the various processing stations employed in the printing machine illustrated in FIG. 1 will be described only briefly.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A P/R of this type is disclosed in U.S. Pat. No. 4,265,990 isued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain.

Belt 10 is maintained in tension by a pair of springs (not shown) resiliently urging tension roller 20 against belt 10 with the desired spring force. Both stripping roller 18 and tension roller 20 are rotatably mounted. These rollers are idlers wihch rotate freely as belt 10 moves in the direction of arrow 16.

With continued reference to FIG. 1, initially a potion of belt 10 passes through charging station A. At charging station A, a corona device, indicated generally by the reference numeral 25, charges layer 12 of belt 10 to a relatively high, substantially uniform negative potential. A suitable corona generating device for negatively charging the P/R belt 10 comprises a conductive shield 26 and corona wire 27 the latter of which is coated with an electrically insulating layer 28 having a thickness which precludes a net d.c. corona current when an a.c. voltage is applied to the corona wire. When the potential of the shield is higher than the P/R surface potential, an average d.c. current is delivered to the photoconductor. The polarity of the average d.c. current is the polarity of the shield potential.

Next, the charged portion of the P/R belt is advanced through exposure station B. At exposure station B, an original document 30 is positioned face down upon a transparent platen 32. The light rays reflected from original document 30 form images which are transmitted through lens 36 the light images are projected onto the charged portion of the P/R belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the P/R belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generatng device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, whch permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

At a brush detoning/toning station F (i.e. location where toner is first picked up from the P/R and temporarily stored in the brush fibers for subsequent depositing of the toner back onto the P/R so that it can be transported to the development station C for removal thereat) there is provided a conductive brush 64. The brush is adapted to be cyclically moved in a direction substantially perpendicular to the direction of movement of the photoconductive belt 10. Such movement may be accomplished by means of a cam structure 70 operatively connected to a motor 72.

The electrically conductive brush 64 comprises conductive fibers of steel, carbon coated nylon, carbon or graphite. The density of the fibers which have diameter in the order of 10–60 microns and a resistivity of $10^{-6}$ to $10^{6}$ ohm-cm is in the order of 15–60K/in.$^2$.

The switch 74 arrangement shown in FIG. 2 allows the brush to be connected to ground through a positive d.c. source 78 and a negative d.c. source 80 via terminals 82 and 84, respectively. When the toner is positive, the switch 74 connects the brush to ground through the negative d.c. source 80 during the toner removal operation after which it connects the brush to ground through the positive source in order to detone the brush or deposit the toner onto the P/R to be transported thereby to the development staton C for removal from the P/R. In this manner, positive toner is stored in the brush until the brush reaches its toner holding capacity and then it is deposited onto the P/R. When negative toner is used, a positively biased brush is required for attracting toner from the P/R, and a negative biased brush is required during the brush detoning step.

As illustrated in FIG. 3, the amount of toner that can be stored in the brush until detoning is necessitated is a function of factors such as area or copy coverage and the transfer efficiency (i.e. the effectiveness with which the toner is transferred to the copy paper), therefore, the total number of copies that can be made without detoning the brush, as can be seen from the curves shown in FIG. 3, can vary from 15 to about 800 for the same brush.

A switch 90 is provided for connecting the charge corotron 28 to an A.C. power supply 92 at the appropriate time and for disconnecting it while the brush is being detoned so as not to alter the toner charge before it reaches the development housing for removal thereof.

As can be seen from the foregoing description, there has been disclosed a toner removal system for a xerographic reproducing or printing apparatus which uses the development system for the dual function of developing latent electrostatic images and removing non-transferred toner from the P/R belt for reuse in developing the latent images. This is accomplished in a simple manner utilizing existing components of the machine. To this end it is seen that a brush which would in prior art devices normally be used for only removing toner from the P/R is also used in conjunction with the P/R to reclaim the already used toner by storing the toner for a period of time in the brush and then using the P/R belt to transport the toner to the development station for removal therefrom. In a copending application Ser. No. 438,227 filed Nov. 1, 1982 in the name of Bean et al and assigned to the same assignee as the instant application, there is disclosed a brush which picks up toner and places it back on the P/R but this is only done for the purpose of redistributing the toner across the P/R surface and not for storing the toner for a number of cycles with subsequent deposition of the toner onto the P/R.

What is claimed is:

1. Reproducing apparatus including a charge retentive surface on which toner images are formed for transfer to a copy substrate, said surface having diposed adjacent thereto charge, exposure and development systems which are capable of forming a visible image on said charge retentive surface by applying toner material thereto and also removing residual toner from the surface after the images have been transferred to the substrate, said apparatus comprising:

a conductive brush having fibers supported for contact with said surface;

means cooperating with said brush adapted to selectively enhance the brush's ability to attract toner of a predetermined polarity thereto;

means including a d.c. voltage source adapted to selectively create an electrostatic field about the fibers of said brush, the polarity of said field being the same as said predetermined polarity;

means operatively coupled to said electrostatic field creating means and said means for enhancing the brush's toner attracting ability for alternately rendering them operative whereby said brush is able to collect toner in the fibers thereof and store is until the electrostatic field of opposite polarity is established whereupon the toner is repelled from the brush such that it is deposited on the surface to be transported to the development system for removal; and means cooperating with said charge system to render it temporarily inoperative to allow movement of said toner repelled from said brush to be transported to said development system without altering the charge on said toner by said charge system.

* * * * *